US011072056B2

(12) United States Patent
Tsai

(10) Patent No.: US 11,072,056 B2
(45) Date of Patent: Jul. 27, 2021

(54) GRIP BAR FOR HEXAGONAL WRENCH

(71) Applicant: Chung-Yu Tsai, Taichung (TW)

(72) Inventor: Chung-Yu Tsai, Taichung (TW)

( * ) Notice: Subject to any disclaimer, the term of this patent is extended or adjusted under 35 U.S.C. 154(b) by 260 days.

(21) Appl. No.: 16/459,624

(22) Filed: Jul. 2, 2019

(65) Prior Publication Data

US 2021/0001460 A1 Jan. 7, 2021

(51) Int. Cl.
*B25B 23/16* (2006.01)
*B25B 23/00* (2006.01)
*B25B 15/00* (2006.01)

(52) U.S. Cl.
CPC ..... *B25B 23/16* (2013.01); *B25B 15/008* (2013.01); *B25B 23/0042* (2013.01)

(58) Field of Classification Search
CPC ..... B25B 23/16; B25B 15/00; B25B 15/008; B25B 23/0042; B25B 13/44; B25B 13/10; B25B 13/14; B25B 13/20; B25B 13/34; B25B 13/48; B25B 9/00; B25G 1/00; B25G 1/04; B25G 1/08; B25G 1/008; B25G 1/085; B25G 1/105; B25G 3/00; B25G 3/02; B25G 3/12; B25G 3/38
See application file for complete search history.

(56) References Cited

U.S. PATENT DOCUMENTS 6,332,381 B1 * 12/2001 Vasudeva ..... B25B 15/008 81/177.1
6,971,291 B2 * 12/2005 An ..... B25B 15/008 81/177.2
7,788,996 B2 * 9/2010 Johnson ..... B25B 15/008 81/177.4
9,463,568 B2 * 10/2016 Chen ..... B25G 1/085
9,969,076 B2 * 5/2018 Tsai ..... B25B 15/008
10,618,158 B2 * 4/2020 Liu ..... B25G 1/005

* cited by examiner

*Primary Examiner* — Robert J Scruggs

(57) ABSTRACT

A grip bar for a hexagonal wrench includes a grip, a middle sleeve, an outer sleeve and a rotary member. The grip has an elongate body, a raised portion, multiple first recesses, a head, an elongate slot and a first threaded portion. The middle sleeve includes a first chamber, a first opening, a shoulder and an end hole. The outer sleeve is mounted to the middle sleeve. The rotary member is rotatably inserted in the end hole of the middle sleeve. The first and second threaded portion are connected to each other. The first recesses and the elongate slot respectively accommodate the first section and the second section of a hexagonal wrench. The grip and the rotary member respectively restricted by the shoulder and cannot slip within the middle sleeve so that the hexagonal wrench is firmly combined with the grip and operated efficiently.

11 Claims, 10 Drawing Sheets

GRIP BAR FOR HEXAGONAL WRENCH

BACKGROUND OF THE INVENTION

1. Fields of the Invention

The present invention relates to a grip bar for a hexagonal wrench, and more particularly, to a multiple function grip bar for a hexagonal wrench.

2. Descriptions of Related Art

The conventional connection device for a hexagonal wrench known to applicant is disclosed in U.S. Pat. No. 9,969,076, and comprises a first part having an insertion section. Two first engaging portions are formed on the first end of the insertion section, and two second engaging portions are formed on the second end of the insertion section. The two first engaging portions each are a hook, and the second engaging portions each are a ridge protruding from the outer surface of the insertion section. The insertion section has a first operation portion formed on the outer surface thereof. Multiple first recesses are defined in the first operation portion and each have a hexagonal shape. The first recesses are defined through the insertion section and are arranged in sequence by sizes. A second operation portion protrudes from the second end of the first part and has multiple second recesses which have a hexagonal shape and different sizes. The first recesses and the second recesses are Matric system and English system. The insertion section has a stepped recess defined axially in the first end thereof. The size of the stepped recess becomes smaller from the first end toward the second end of the insertion section. The first recesses communicates with the stepped recess. A second part has a reception hole defined in the first end thereof. The insertion section is inserted into the reception hole which has two third engaging portions formed in the first end of the second part. Two fourth engaging portions are formed in the second end of the second part. The third engaging portions are defined in the inner surface of the reception hole and are two recesses. The fourth engaging portions are two rectangular holes defined through the wall of the second part. The third and fourth engaging portions are sized to be engaged with the first engaging portions when the insertion section is moved along the reception hole. Two fifth engaging portions are formed in the inner surface of the second end of the reception hole and each of the fifth engaging portion is a groove so as to receive the second engaging portion therein. A protrusion extends from the inner surface of the reception hole and is accommodated in the stepped recess so as to define a gap between the top of the protrusion and the inner surface of the stepped recess. The second part has an opening which communicates with the reception hole. The first operation portion and the first recesses are exposed from the opening which is a rectangle-shaped opening. A third operation portion extends from the second end of the second part and has multiple third recesses which have different sizes. The third recesses are hexagonal recesses which are Matric system recesses and English recesses, and the outer periphery of the reception hole has at least two first limit faces. The inner periphery of the insertion section has at least two second limit faces, and the at least two first limit faces contact the at least two second limit faces so as to restrict the first part rotating with respect to the second part.

The first engaging portions of the first part are engaged with the third engaging portions of the second part, and the second engaging portions are engaged with the fifth engaging portions. However, the first and second parts each are made by plastic injection molding so that when rotating the first and second parts to rotate the hexagonal wrench to rotate an object, the first engaging portions of the first part may be separated from the third engaging portions of the second part, and the second engaging portions may be separated from the fifth engaging portions.

The present invention intends to provide a grip bar for a hexagonal wrench, and the grip bar eliminates the shortcomings mentioned above.

SUMMARY OF THE INVENTION

The present invention relates to a grip bar for a hexagonal wrench and comprises a grip, a middle sleeve, an outer sleeve and a rotary member. The grip has an elongate body, a raised portion, multiple first recesses, a head, an elongate slot and a first threaded portion. The middle sleeve includes a first chamber, a first opening, a shoulder and an end hole. The outer sleeve is mounted to the middle sleeve. The rotary member is rotatably inserted in the end hole of the middle sleeve. The first and second threaded portion are connected to each other. The first recesses and the elongate slot respectively accommodate the first section and the second section of a hexagonal wrench. The grip and the rotary member respectively restricted by the shoulder and cannot slip within the middle sleeve so that the hexagonal wrench is firmly combined with the grip and operated efficiently.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
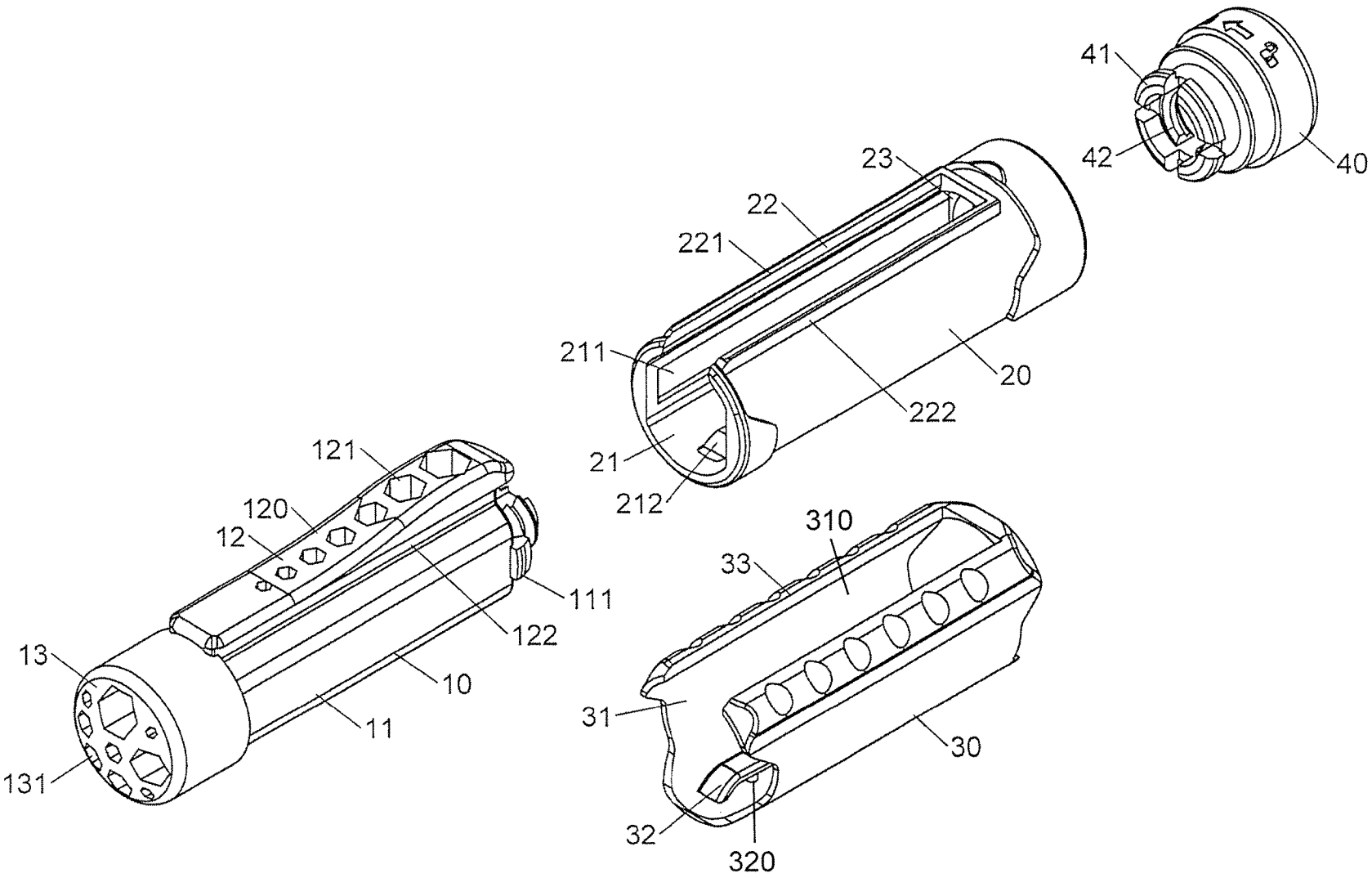
FIG. 1 is an exploded view of the grip bar of the present invention.
Figure 4:
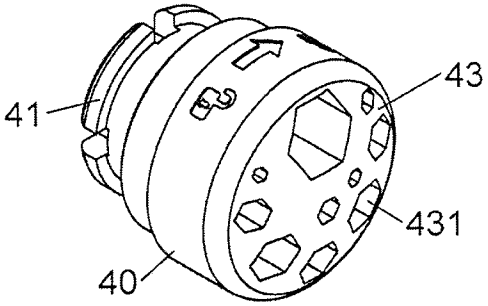
FIG. 4 is a perspective view to show the rotary member of the present invention.
Figure 3:
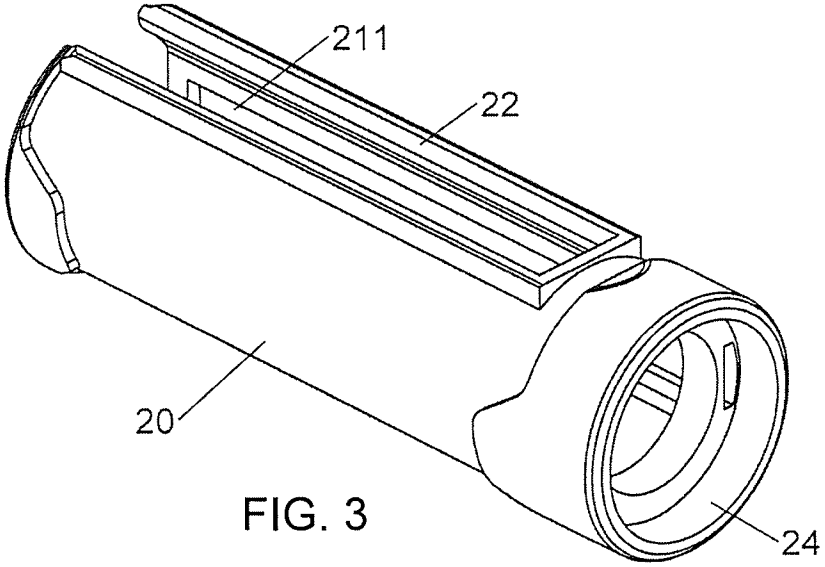
FIG. 3 is a perspective view to show the middle sleeve of the present invention.
Figure 2:
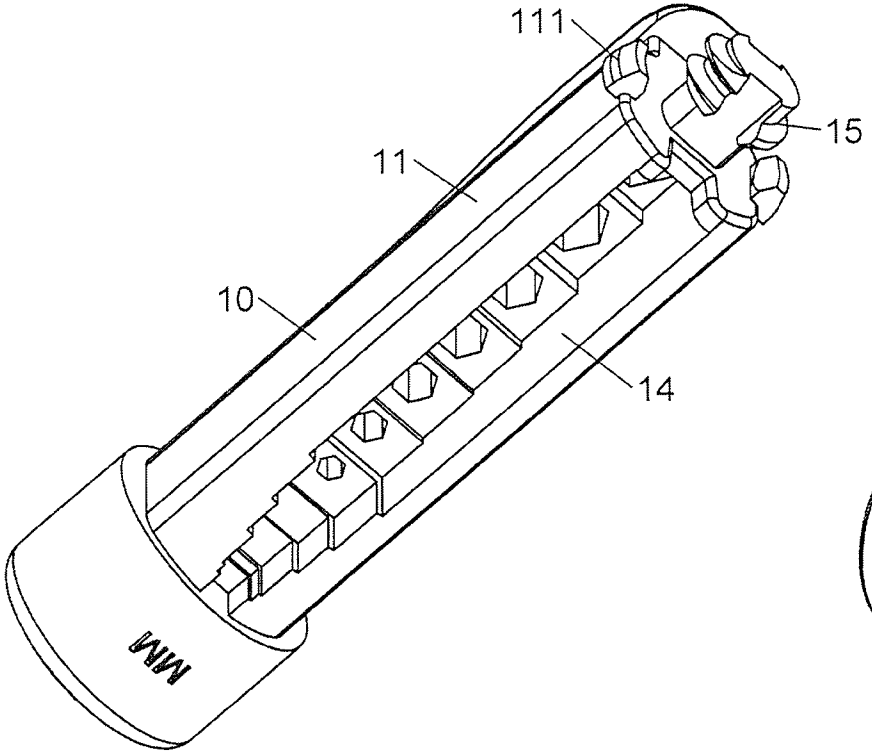
FIG. 2 is a perspective view to show the grip of the present invention.
Figure 5:
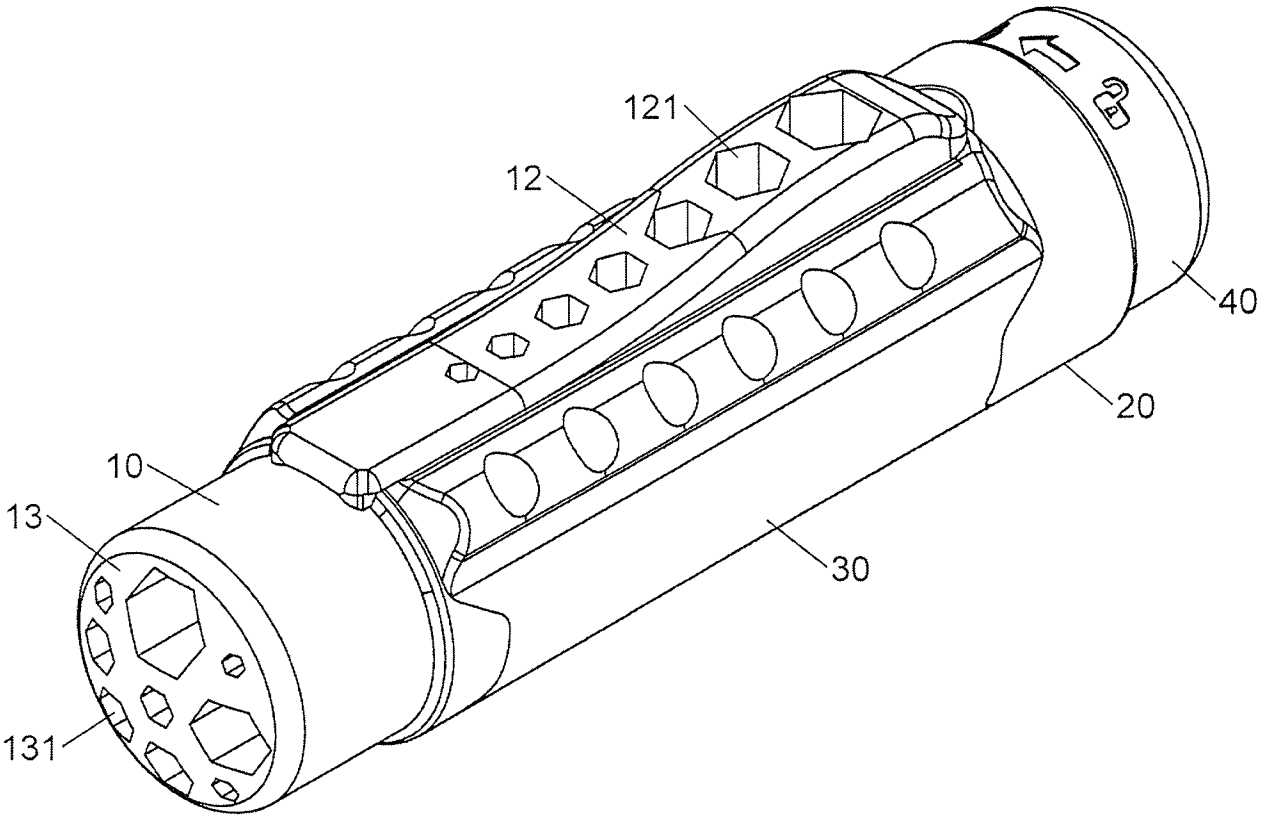
FIG. 5 is a perspective view to show the grip bar of the present invention.

Referring to FIGS. 1 to 14, the grip bar for a hexagonal wrench of the present invention comprises a grip 10 having an elongate body 11 and a head 13 is formed on the first end of the body 11. Two first hook portion 111 are formed on the second end of the body 11. The first end of the elongate body 11 is a round and cylindrical body. An elongate slot 14 is defined axially in the body 11. A raised portion 12 protrudes axially from the body 11 and is located in opposite to the elongate slot 14. The height of the raised portion 12 increases from the first end of the elongate body 11 toward the second end of the elongate body 11. The top face 120 of the raised portion 12 is a curved face. The radial height of the elongate slot 14 increases from the first end of the elongate body 11 toward the second end of the elongate body 11. Multiple first recesses 121 of different sizes are defined through the top face 120 of the raised portion 12 and communicate with the elongate slot 14. The first recesses 121 are hexagonal recesses of Metric system or English system. The size of the first recesses 121 increases from the first end of the elongate body 11 toward the second end of the elongate body 11. In this embodiment, there are six first recesses 121. Two grooves 122 are respectively defined in two sides of the raised portion 12. The head 13 includes multiple second recesses 131 of different sizes defined in the end face thereof. The head 13 includes a semi spherical face in which the second recesses 131 are defined. The first recesses 121 and the second recesses 131 are hexagonal recesses and have different Metric system/English system from each other. A first threaded portion 15 protrudes from the second end of the elongate body 11. The first recesses 121 accommodate the first section 51 of a hexagonal wrench 50, and the elongate slot 14 accommodates the second section 52 that extends from the first section 51 of the hexagonal wrench 50.

A middle sleeve 20 includes a first chamber 21 defined axially in the first end thereof, and an end hole 24 is defined axially in the second end of the middle sleeve 20. A shoulder 23 is formed between the first chamber 21 and the end hole 24. The elongate body 11 is inserted into the middle sleeve 20 from the first chamber 21. Two guide slots 211 are respectively defined in two insides of the first chamber 21. The two first hook portions 111 slidably located within the two guide slots 211. Each of the first hook portions 111 contacts the end shoulder of the guide slot 211 corresponding thereto. A protrusion 212 extends from the inner bottom of the first chamber 21 and is located within the elongate slot 14. The protrusion 212 includes at least one hole 2120 defined through the protrusion 212 and the wall of the middle sleeve 20. A room 140 is defined between the top of the protrusion 212 and the inner periphery of the elongate slot 14. The room 140 accommodates the second section 52 of the hexagonal wrench 50. The middle sleeve 20 has a first opening 22 defined axially from the first end thereof and through the wall of the middle sleeve 20. The first opening 22 is ended before the second end of the middle sleeve 20. The raised portion 12, the top face 120 of the raised portion 12 and the first recesses 121 are exposed from the first opening 22. A ridge 222 and a rail 221 extend from each of two opposite sides of the first opening 22, and the two rails 221 are slidably engaged with the two grooves 122. The middle sleeve 20 includes a cross section of a round and tubular outer periphery at the middle section thereof.

An outer sleeve 30 is a hollow case and mounted to the outside of the middle sleeve 20. The outer sleeve 30 includes a second chamber 31 defined therein and the middle sleeve 20 is received in the second chamber 31. An engaging portion 32 is located in the elongate slot 14 and protrudes from the inner periphery of the second chamber 31 and mounted to the protrusion 212. The top of the engaging portion 32 is located in the first chamber 21. The room 140 is defined between the top of engaging portion 32 and the inner periphery of the elongate slot 14. The outer sleeve 30 includes a second opening 310 defined axially through the wall thereof. Two match portions 33 are respectively formed in two opposite sides of the second opening 310 and contact the two ridges 222. It is noted that the outer sleeve 30 is mounted to the middle sleeve 20 by way of plastic injection molding, so that plastic material is filled in the at least one hole 2120 to form at least one rib 320 filled in the at least one hole 2120.

A rotary member 40 has multiple second hook portions 41 extending from the first end thereof, and the rotary member 40 rotatably received in the end hole 24 of the middle sleeve 20. The second hook portions 41 are located in the first chamber 21 and engaged with the shoulder 23. A second threaded portion 42 extends from the first end of the rotary member 40 and is threadedly connected to the first threaded portion 15 of the body 11 so that the grip 10 and the rotary member 40 are restricted by the two sides of the shoulder 23 and cannot slip relative to the middle sleeve 20. The rotary member 40 has multiple third recesses 431 of different sizes defined in an end face 43 on the second end of the rotary member 40. The end face 43 protrudes beyond the second end of the middle sleeve 20. The second recesses 131 and the third recesses 431 can receive the first section 51 or the second section 52 of the hexagonal wrench 50. In this embodiment, the end face 43 includes a semi spherical face in which the third recesses 431 are defined. The third recesses 431 are hexagonal recesses and can be in Metric system or English system.

Figure 6:
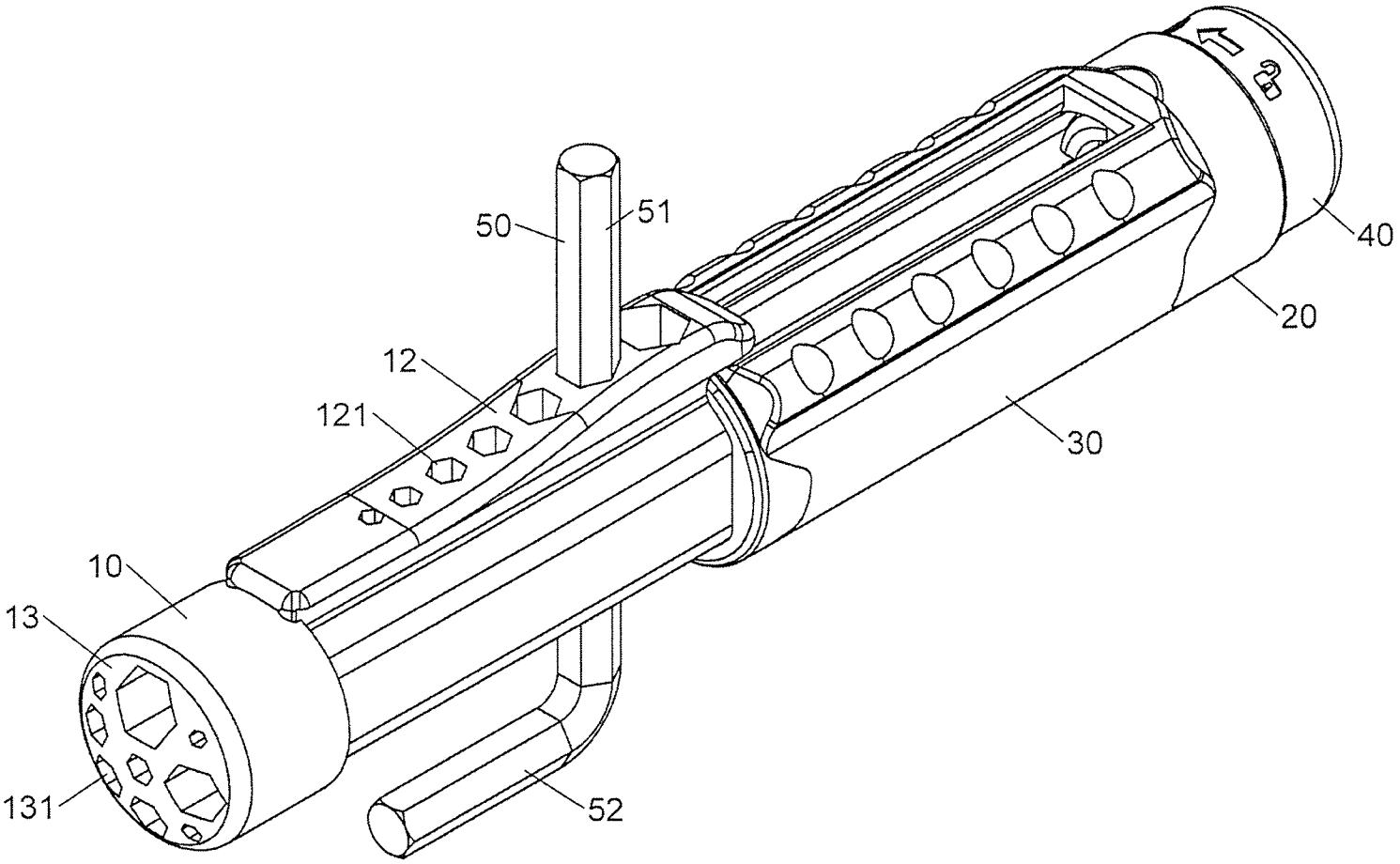
FIG. 6 shows that the first section of the wrench extends through the grip bar of the present invention.
Figure 7:
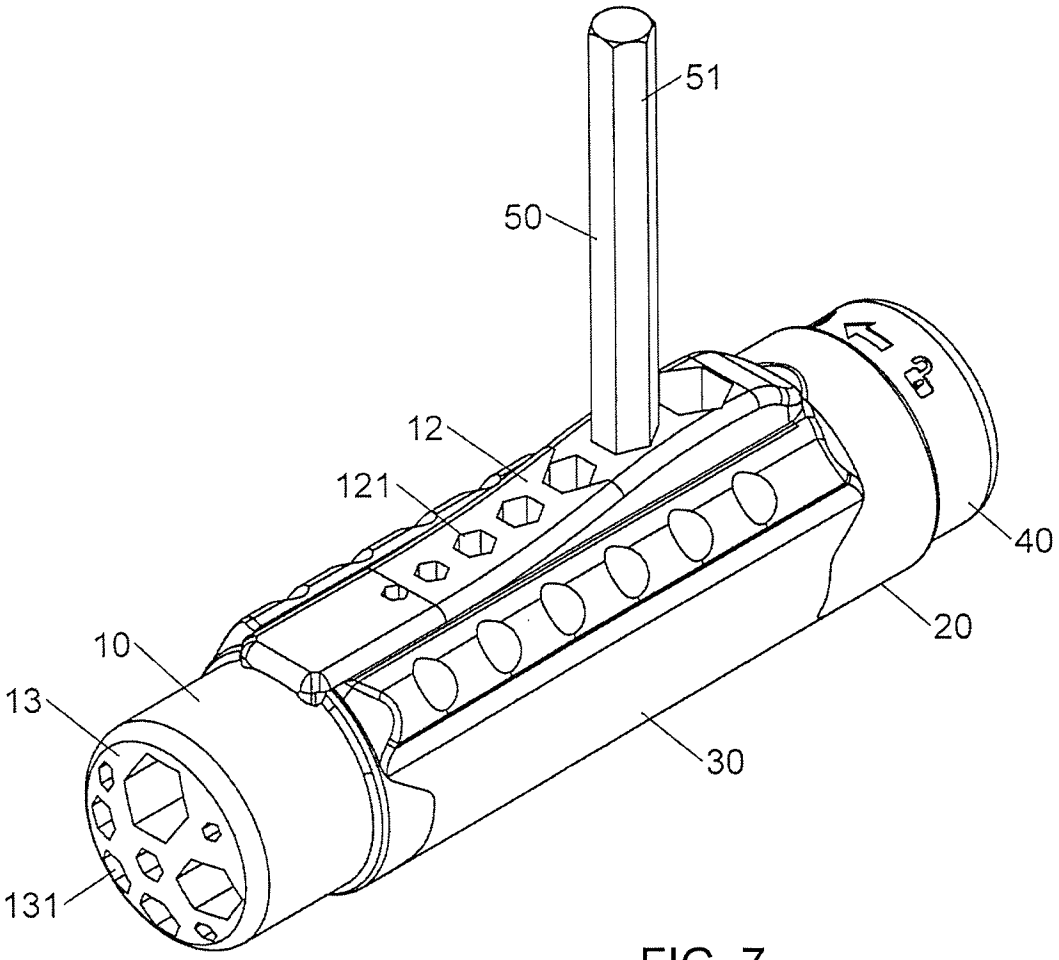
FIG. 7 shows that the second section of the hexagonal wrench is inserted in the elongate slot of the grip bar of the present invention.

As shown in FIGS. 6 and 7, the hexagonal wrench 50 is an L-shaped wrench and includes the first and second sections 51, 52, wherein the second section 52 is shorter than the first section 51. When in use, the user rotates the rotary member 40 relative to the grip 10 and the middle sleeve 20, to separate the second threaded portion 42 from the first threaded portion 15. Therefore, the grip 10 can be pulled out from the first chamber 21. The first hook portions 111 slide in the guide slots 211, and the rails 221 move relative to the grooves 122. When the first hook portion 111 contact the front end wall of the guide slots 211, the first section 51 can extend through one of the first recesses 121, and the second section 52 is located in the elongate slot 14. The grip 10 is then pushed back to let the body 11 accommodated in the first chamber 21. The rotary member 40 is then rotated relative to the grip 10 and the middle sleeve 20 to threadedly connect the second threaded portion 42 to the first threaded portion 15 to secure the grip 10 relative to the grip 10 and the middle sleeve 20. The second section 52 is located in the elongate slot 14.

Figures 8, 9, 10:
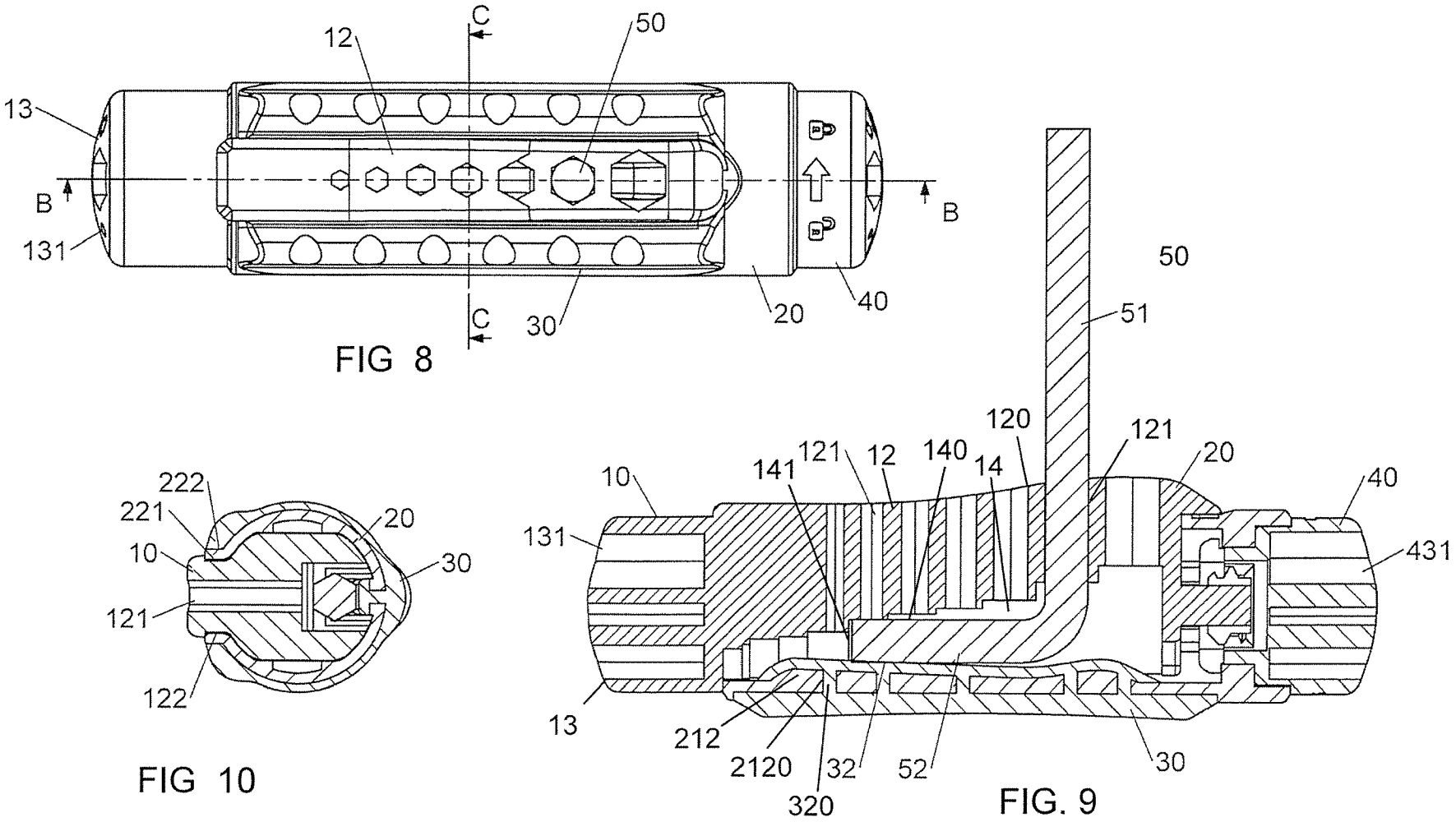
FIG. 8 is shows the top view of the grip bar of the present invention while the hexagonal wrench is inserted in one of the first recesses.
FIG. 9 is a cross sectional view, taken along line B-B of FIG. 8.
FIG. 10 is a cross sectional view, taken along line C-C of FIG. 8.
Figure 11:
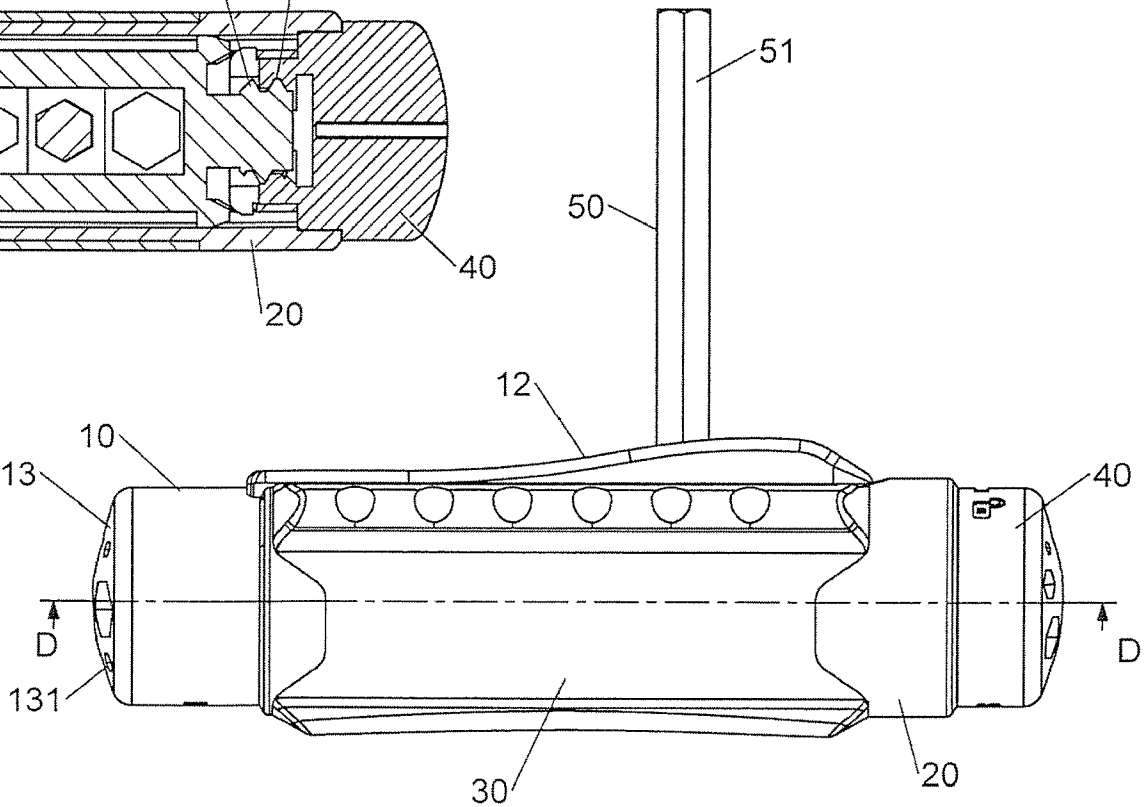
FIG. 11 is a side view of the grip bar of the present invention.
Figure 12:
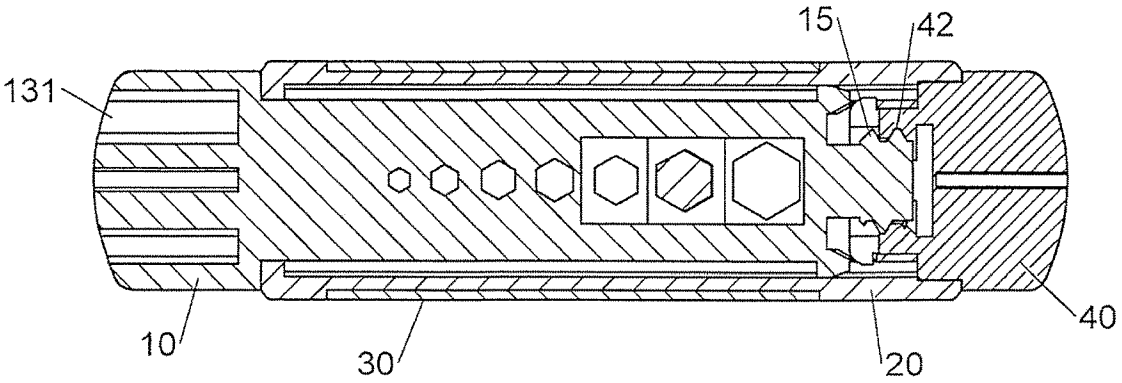
FIG. 12 is a cross sectional view, taken along line D-D of FIG. 11.
Figure 13:
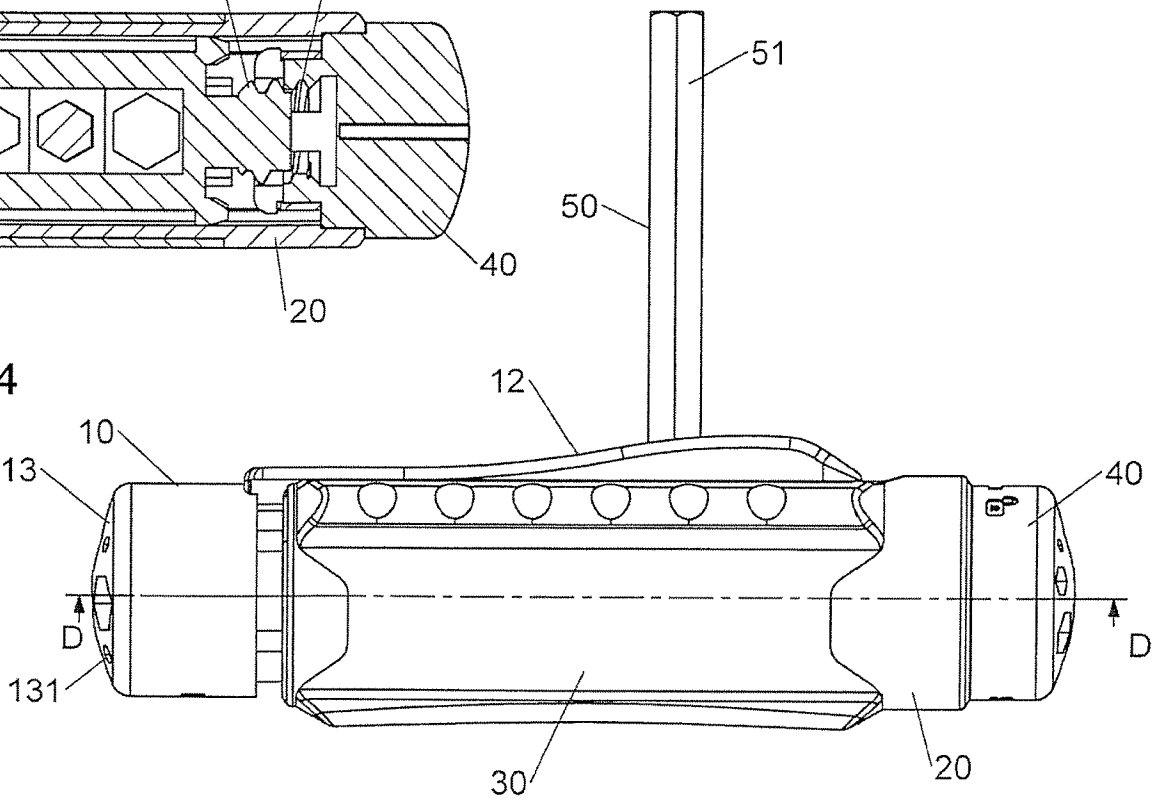
FIG. 13 is a side view to show that the hexagonal wrench is connected to the grip bar of the present invention.
Figure 14:
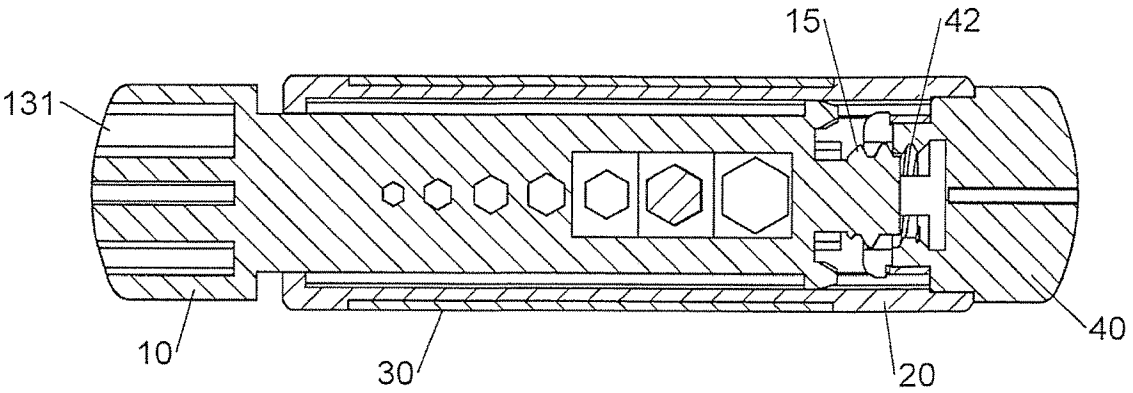
FIG. 14 is a cross sectional view, taken along line D-D of FIG. 13.

As shown in FIGS. 8 and 9, the second section 52 is located between the elongate slot 14 and the engaging portion 32. The second section 52 is restricted by the inside of the elongate slot 14 and the top of the engaging portion 32, so that the hexagonal wrench 50 is rotated by rotating the grip 10 and the middle sleeve 20.

Figure 15:
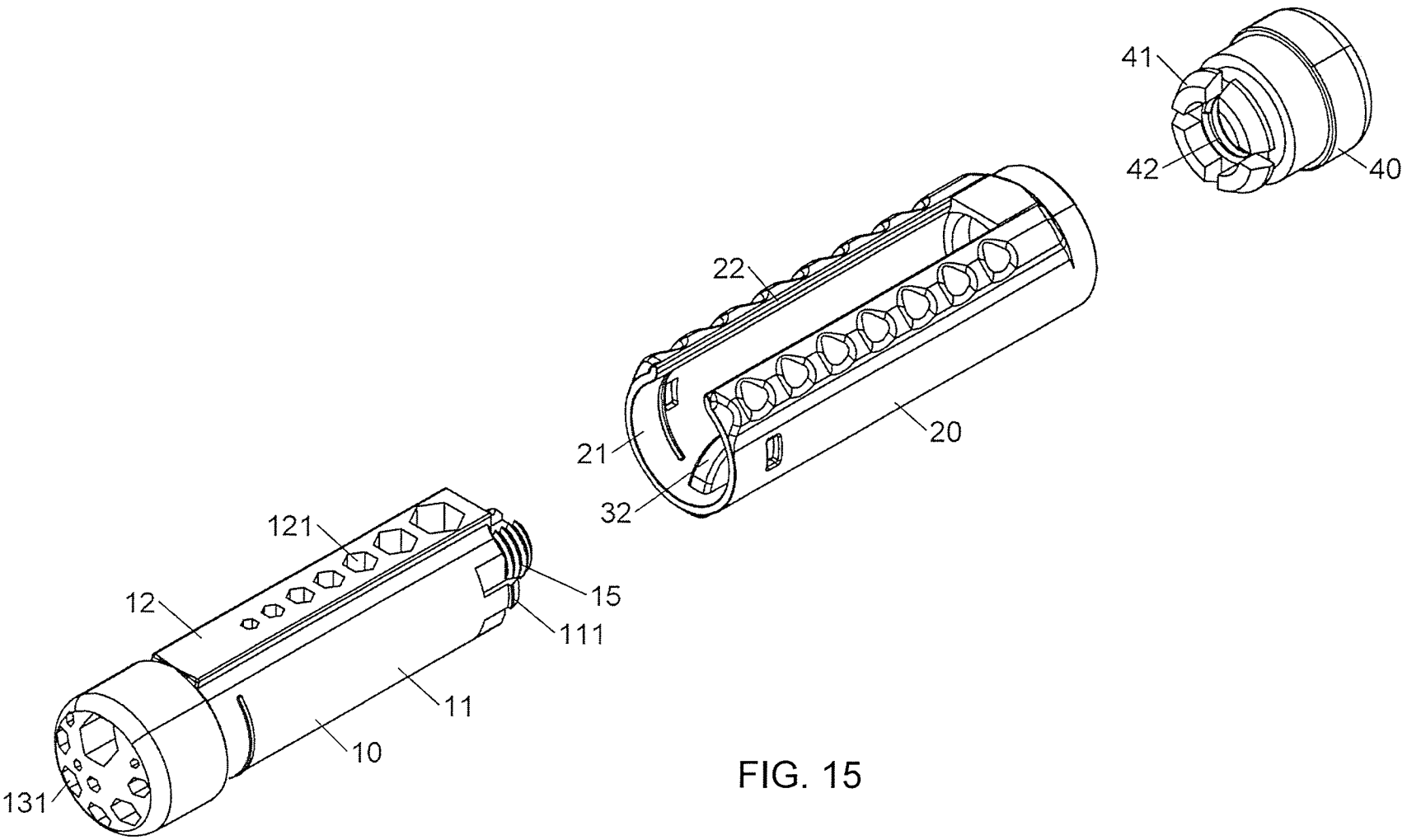
FIG. 15 is an exploded view of the second embodiment of the grip bar of the present invention.

As shown in FIG. 15, the top face 120 of the raised portion 12 is a flat face. The middle sleeve 20 and the outer sleeve 30 are integrally formed. The top of the engaging portion 32 protrudes in the first chamber 21. The shapes of the grip 10, the middle sleeve 20, the outer sleeve 30 and the rotary member 40 are different from those in the first embodiment.

Figure 16:
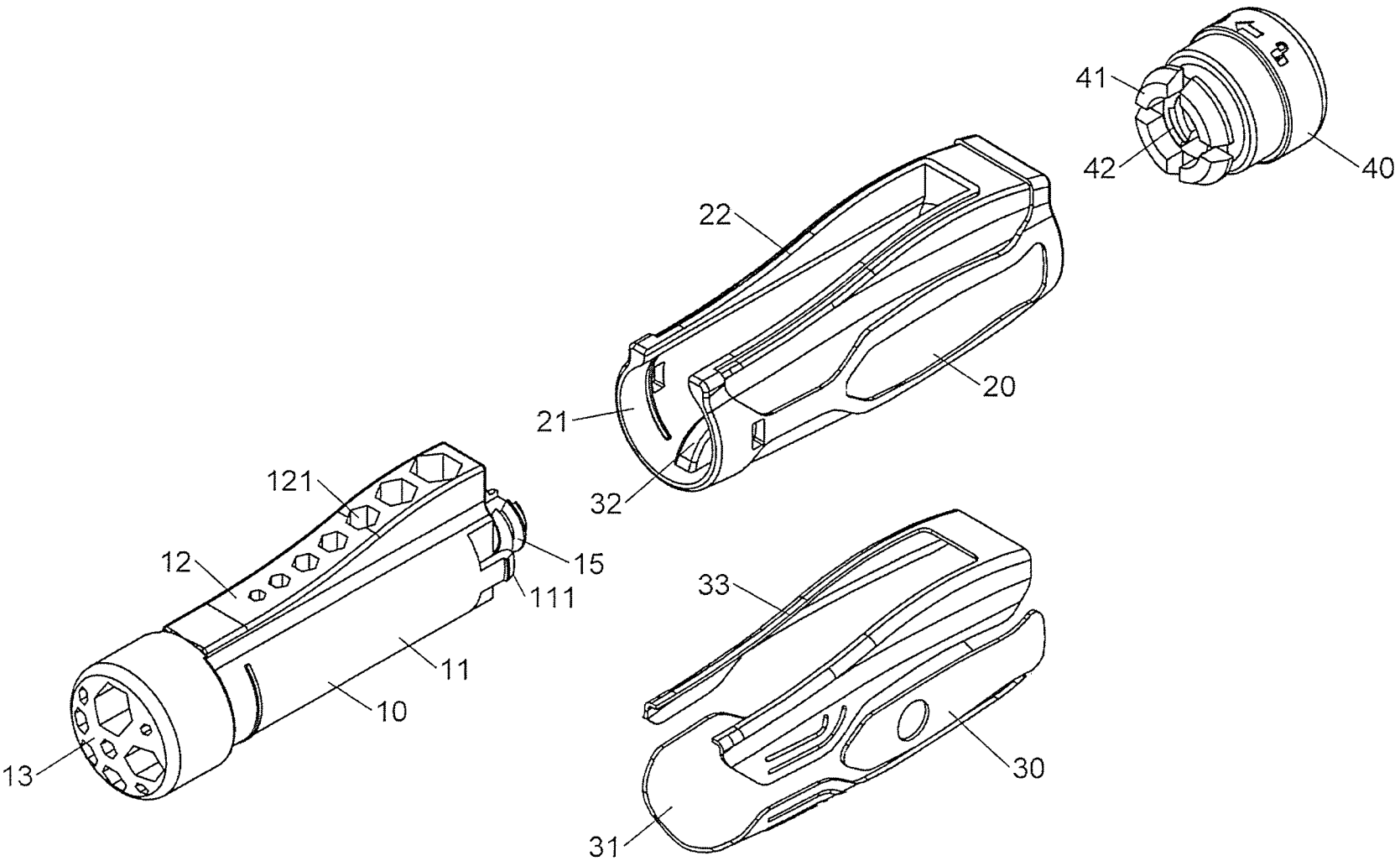
FIG. 16 is an exploded view of the third embodiment of the grip bar of the present invention.

As shown in FIG. 16, the engaging portion 32 is located at the middle sleeve 20, the engaging portion 32 and the protrusion 212 are formed as a one-piece. The engaging portion 32 is exposed in the first chamber 21. The shapes of the grip 10, the middle sleeve 20, the outer sleeve 30 and the rotary member 40 are different from those in the first embodiment.

The advantages of the present invention are that the second threaded portion 42 is connected to the first threaded portion 15 to let the grip 10 and the middle sleeve 20 secure the hexagonal wrench 50.

When rotating the grip 10 and the middle sleeve 20, the torque of rotation cannot let the rotary member 40 to be rotated in the end hole 24, and the user's hand does not touch the rotary member 40. The grip 10 is locked by the restriction of the middle sleeve 20, so that the grip 10 is not separate from the middle sleeve 20. The user can stably operate the hexagonal wrench 50.

The rotary member 40 is rotated to separate the second threaded portion 42 from the first threaded portion 15. The grip 10 is not restricted by the rotary member 40, and can be pulled out from the first chamber 21.

The rotary member 40 is rotated in the end hole 24 to separate the second threaded portion 42 from the first threaded portion 15, or to connect the second threaded portion 42 to the first threaded portion 15, so as to control the grip 10 to be slid in the first chamber 21. In other words, the rotation of the rotary member 40 controls the grip 10 to be locked or unlocked relative to the middle sleeve 20.

The two first hook portions 111 slidably located within the two guide slots 211, and the rails 221 move relative to the grooves 122, so that the grip 10 is not rotated relative to the middle sleeve 20.

While we have shown and described the embodiment in accordance with the present invention, it should be clear to those skilled in the art that further embodiments may be made without departing from the scope of the present invention.

What is claimed is:

1. A grip bar for a hexagonal wrench, comprising:

a grip having an elongate body and a head formed on a first end of the body, two first hook portion formed on a second end of the body, an elongate slot defined axially in the body, a raised portion protruding axially from the body and located in opposite to the elongate slot, multiple first recesses of different sizes defined through a top face of the raised portion and communicating with the elongate slot, two grooves respectively defined in two sides of the raised portion, the head including multiple second recesses of different sizes defined in an end face thereof, a first threaded portion protruding from the second end of the elongate body, the first recesses adapted to accommodate a first section of a hexagonal wrench, the elongate slot adapted to accommodate a second section that extends from the first section of the hexagonal wrench;

a middle sleeve having a first chamber defined axially in a first end thereof and an end hole defined axially in a second end of the middle sleeve, a shoulder formed between the first chamber and the end hole, the elongate body inserted into the middle sleeve from the first chamber, two guide slots respectively defined in two insides of the first chamber, the two first hook portions slidably located within the two guide slots, each of the first hook portions contacting an end shoulder of the guide slot corresponding thereto, a protrusion extending from an inner bottom of the first chamber and located within the elongate slot, a room defined between the a top of the protrusion and an inner periphery of the elongate slot, the room adapted to accommodate the second section of the hexagonal wrench, the middle sleeve having a first opening defined axially from the first end thereof and through a wall of the middle sleeve, the first opening being ended before the second end of the middle sleeve, the raised portion, the top face of the raised portion and the first recesses being exposed from the first opening, a ridge and a rail extending from each of two opposite sides of the first opening, the two rails slidably engaged with the two grooves;

an outer sleeve mounted to an outside of the middle sleeve, and a rotary member having multiple second hook portions extending from a first end thereof, the rotary member rotatably received in the end hole of the middle sleeve, the second hook portions being located in the first chamber and engaged with the shoulder, a second threaded portion extending from the first end of the rotary member and threadedly connected to the first threaded portion of the body so that the grip and the rotary member cannot slip relative to the middle sleeve, the rotary member having multiple third recesses of different sizes defined in an end face on a second end of the rotary member, the end face protruding beyond the second end of the middle sleeve, the second recesses and the third recesses adapted to receive the first section or the second section of the hexagonal wrench.

2. The grip bar for a hexagonal wrench as claimed in claim 1, wherein the first end of the elongate body is a round and cylindrical body, the middle sleeve includes a cross section that has a round and tubular outer periphery.

3. The grip bar for a hexagonal wrench as claimed in claim 1, wherein a height of the raised portion increases from the first end of the elongate body toward the second end of the elongate body, the top face of the raised portion is a curved face, the first recesses are hexagonal recesses of Metric system or English system, the size of the first recesses increases from the first end of the elongate body toward the second end of the elongate body.

4. The grip bar for a hexagonal wrench as claimed in claim 1, wherein there are six first recesses.

5. The grip bar for a hexagonal wrench as claimed in claim 1, wherein the head includes a semi spherical face in which the second recesses are defined, the first recesses and the second recesses are hexagonal recesses and have different Metric system/English system from each other.

6. The grip bar for a hexagonal wrench as claimed in claim 1, wherein a radial height of the elongate slot increases from the first end of the elongate body toward the second end of the elongate body, a height of the raised portion increases from the first end of the elongate body toward the second end of the elongate body.

7. The grip bar for a hexagonal wrench as claimed in claim 1, wherein the top face of the raised portion is a curved face.

8. The grip bar for a hexagonal wrench as claimed in claim 1, wherein the end face includes a semi spherical face in which the third recesses are defined, the third recesses are hexagonal recesses of different sizes in Metric system or English system.

9. The grip bar for a hexagonal wrench as claimed in claim 1, wherein the outer sleeve includes a second chamber defined therein and the middle sleeve is received in the second chamber, an engaging portion is located in the elongate slot and protrudes from an inner periphery of the second chamber and mounted to the protrusion, a top of the engaging portion is located in the first chamber, the room is defined between the top of engaging portion and the inner periphery of the elongate slot, the room is adapted to accommodate the second section of the hexagonal wrench, the outer sleeve includes a second opening defined axially through a wall thereof, two match portions are respectively formed in two opposite sides of the second opening and contact the two ridges.

10. The grip bar for a hexagonal wrench as claimed in claim 9, wherein the protrusion includes at least one hole defined through the protrusion and the wall of the middle sleeve, the outer sleeve is mounted to the middle sleeve by way of plastic injection molding, the engaging portion includes at least one rib filled in the at least one hole.

11. The grip bar for a hexagonal wrench as claimed in claim 1, wherein the top face of the raised portion is a flat face, the middle sleeve and the outer sleeve are integrally formed, a top of the engaging portion protrudes in the first chamber.

* * * * *